US005178386A

United States Patent [19]

Tzeng

[11] Patent Number: 5,178,386

[45] Date of Patent: Jan. 12, 1993

[54] TRANSPARENT DECORATED THROAT PIECE FOR A RACKET

[76] Inventor: Muh-Wu Tzeng, No. 47, Chung-Chiao I St., Hsin-Jen T'sun, Ta-Li Hsiang, Taichung Hsien, Taiwan

[21] Appl. No.: 812,096

[22] Filed: Dec. 23, 1991

[51] Int. Cl.[5] ..... A63B 49/02; A63B 49/06

[52] U.S. Cl. ..... 273/73 G; 273/73 R; 273/73 D

[58] Field of Search ..... 273/73 R, 73 C, 73 D, 273/73 G

[56] References Cited

U.S. PATENT DOCUMENTS

| | | | |
|---|---|---|---|
| 1,823,107 | 9/1931 | Kleinman | 273/73 G |
| 4,828,259 | 5/1989 | Davis | 273/73 C |
| 4,875,679 | 10/1989 | Movilliat et al. | 273/73 R |
| 4,889,338 | 12/1989 | Keijiro | 273/73 R X |

FOREIGN PATENT DOCUMENTS

| | | | |
|---|---|---|---|
| 3124101 | 1/1983 | Fed. Rep. of Germany | 273/73 R |

*Primary Examiner*—V. Millin
*Assistant Examiner*—Raleigh W. Chiu
*Attorney, Agent, or Firm*—Oblon, Spivak, McClelland, Maier & Neustadt

[57] ABSTRACT

A throat piece for a racket includes a throat body made of a transparent rigid plastic and having a series of spaced string holes formed thereon. The throat body has a curved top face, a bottom face and a pair of racket engaging sides which interconnect the top and bottom faces. The bottom face is formed with a narrow card receiving slot of predetermined depth so as to receive a thin printed card. At least one of the engaging sides is provided with a socket to receive a decorative plug. A protective string guide is disposed adjacent to the bottom face and has a plate portion which supports the printed card in the card receiving slot and a series of tubular string receiving portions extending upwardly from the plate portion and into the string holes. The throat piece can thus obviate the need for executing a painting or fastening step to print the manufacturer's logo or brand name thereon.

6 Claims, 7 Drawing Sheets

TRANSPARENT DECORATED THROAT PIECE FOR A RACKET

BACKGROUND OF THE INVENTION

1. Field of the Invention

The invention relates to a throat piece for a racket, more particularly to a transparent, decorated throat piece for a racket.

2. Description of the Related Art

The conventional throat pieces used on most rackets are plain and dull in appearance. After the throat pieces have been formed, a painting or fastening step is then executed to print the manufacturer's logo or brand name thereon.

SUMMARY OF THE INVENTION

Therefore, the main objective of the present invention is to provide a transparent, decorated throat piece for a racket, which throat piece obviates the need for executing a painting or fastening step to print the manufacturer's logo or brand name thereon.

Accordingly, the preferred embodiment of a throat piece of the present invention is to be used with a racket and comprises: a throat body made of a transparent rigid plastic and having a series of spaced string holes formed thereon, said throat body having a curved top face, a bottom face and a pair of racket engaging sides which interconnect the top and bottom faces, said bottom face being formed with a narrower card receiving slot of predetermined depth, at least one of the engaging sides being provided with a socket means; a thin printed card provided in the card receiving slot; a decorative plug means fittingly received in the socket means; and a protective string guide disposed adjacent to the bottom face and having a plate portion which supports the printed card in the card receiving slot and a series of tubular string receiving portions extending upwardly from the plate portion into the string holes.

BRIEF DESCRIPTION OF THE DRAWINGS

Other features and advantages of the present invention will become apparent in the following detailed description of the preferred embodiments with reference to the accompanying drawings, of which.

DETAILED DESCRIPTION OF THE PREFERRED EMBODIMENTS

Figure 1A:
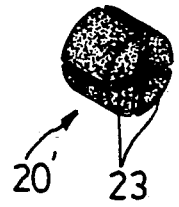
FIG. 1A is an illustration of a decorative plug for the throat piece of the first preferred embodiment.
Figure 1:
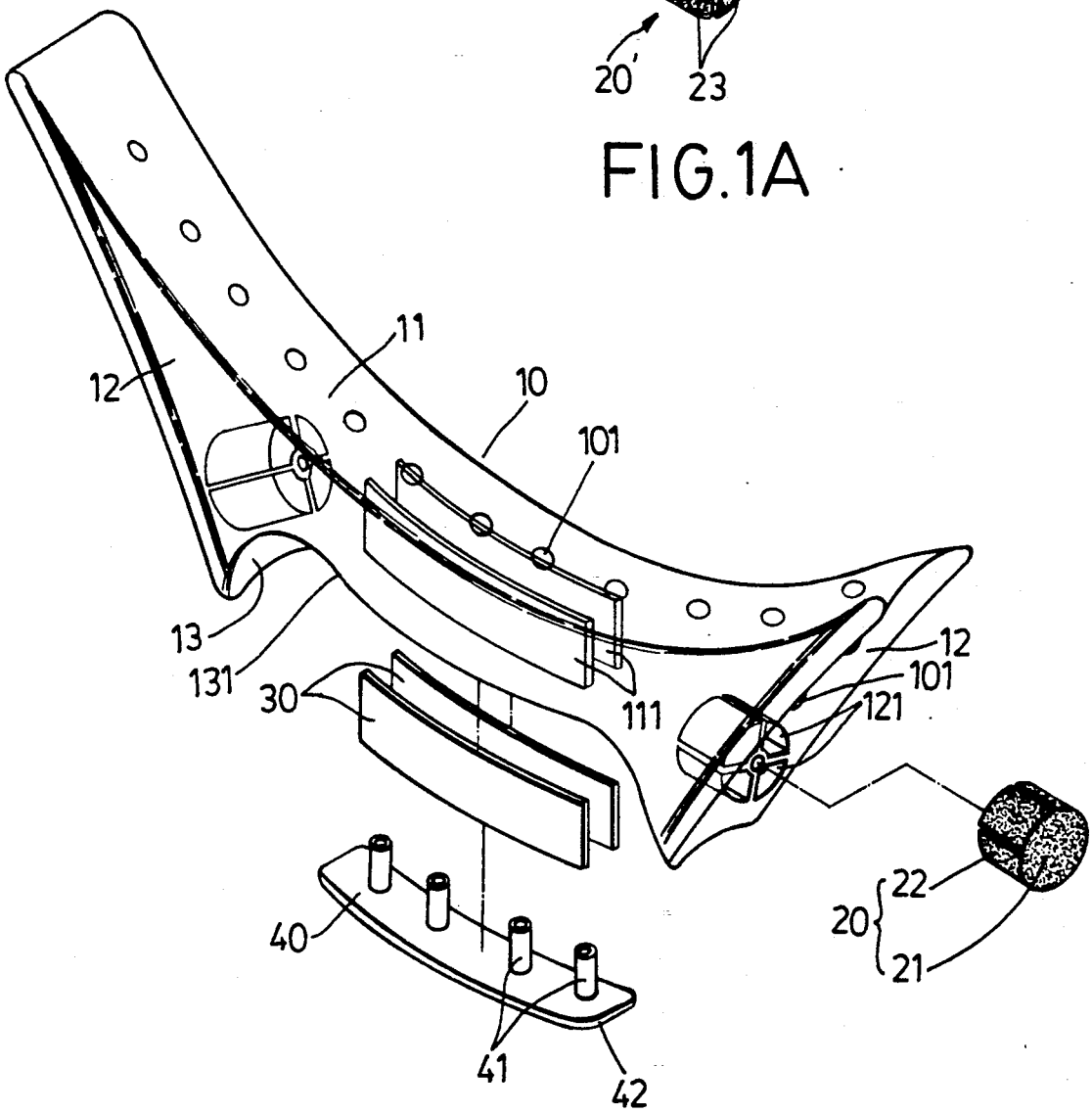
FIG. 1 is an exploded view of the first preferred embodiment of a transparent, decorated throat piece according to the present invention.
Figure 2:
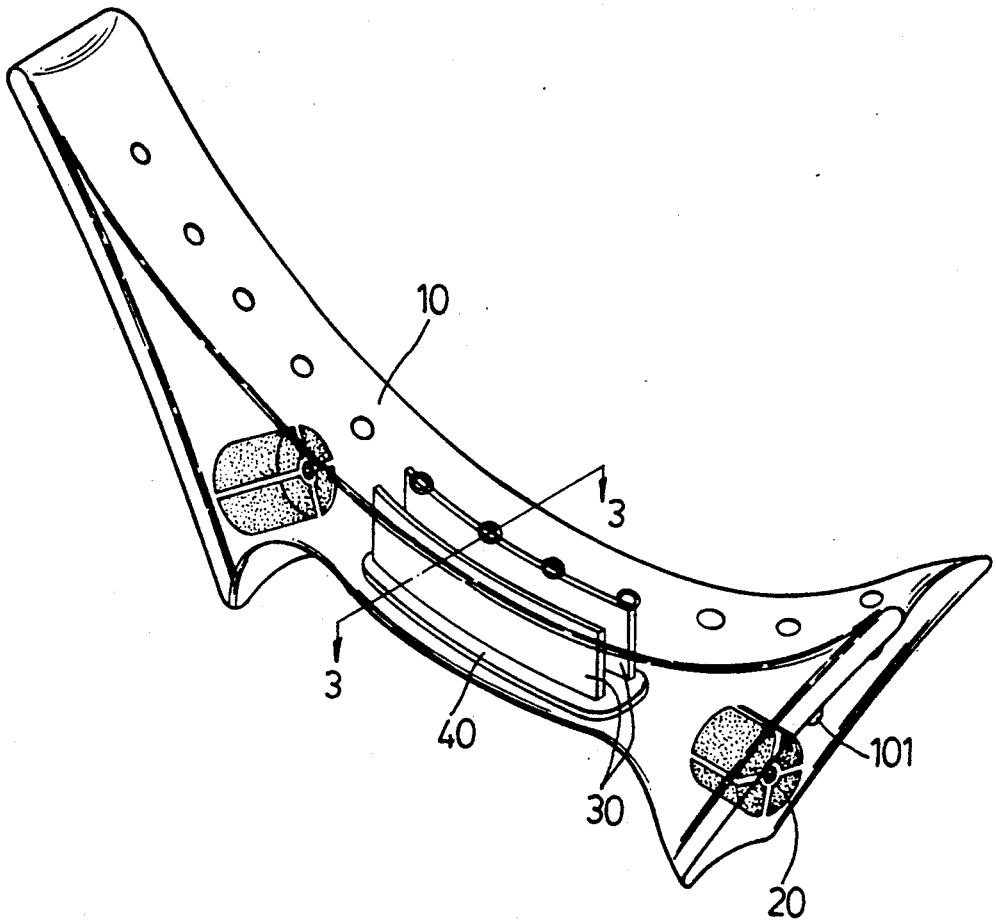
FIG. 2 is a schematic view of the first preferred embodiment illustrating its assembly.
Figure 3:
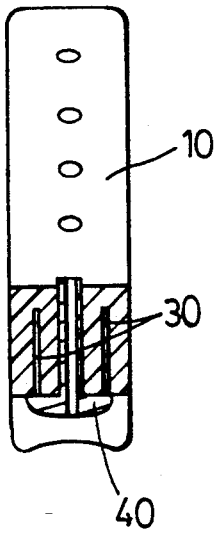
FIG. 3 is a 3—3 section of FIG. 2.

Referring to FIGS. 1 to 4, the first preferred embodiment of a transparent, decorated throat piece according to the present invention is shown to comprise a throat body (10), a pair of decorative plug means (20), a pair of thin printed cards (30) and a protective string guide (40).

The throat body (10) is made of transparent rigid plastic such as nylon. The throat body (10) has a curved top face (11), a bottom face (13) and a pair of racket engaging sides (12) which interconnect the top face (11) and the bottom face (13). The top face (11) has a uniform width. The width of each of the engaging sides (12) gradually expands from the top face (11) to the bottom face (13). The bottom face (13) is provided with a depression (131) which forms a relatively flat central portion therein. The bottom face (13) is further formed with a pair of narrow card receiving slots (111) of predetermined depth. [The slots (111) are formed before string holes are provided on the throat body (10)]. The wider section of each engaging side (12) is formed with a socket means (121) of predetermined depth. [The depth of the socket means (121) should be limited so as to prevent weakening of the throat body (10)]. In the first preferred embodiment, the socket means (121) is formed as four cavities which are substantially quarter-circular in cross-section.

Each of the decorative plugs (20) is adapted to be fitted in one of the socket means (121). Each decorative plug (20) includes a flat surface (21) and four insert portions (22) to be received in a respective one of the cavities of the socket means (121). The decorative plugs (20) can be fabricated to have different colors and can enhance the aesthetic appeal of the throat body (10) when assembled thereon. Fluorescent or condenser agents may be added when manufacturing the decorative plugs (20) so as to permit the decorative plugs (20) to provide fluorescent or glowing effects under dim light conditions.

FIG. 1A illustrates a decorative plug (20') which can be alternatively received in one of the socket means (121). The decorative plug (20') has four separate insert portions (23) to be received in a respective one of the cavities of the socket means (121).

Each of the printed cards (30) is preferably made of a flexible material and is to be fitted in one of the card receiving slots (111) of the throat body (10). One side of each printed card (30) may be printed with the manufacturer's brand name or logo using conventional printing techniques. The throat body (10) is transparent so as to permit the viewing of printings on the printed cards (30).

The protective string guide (40) is conventional in construction and is to be disposed in the flat central portion of the depression (131). The protective string guide (40) is provided with a series of tubular string receiving portions (41) extending into a series of spaced string holes (101) which are formed on the throat body (10). The protective string guide (40) is further provided with a plate portion (42) which supports the printed cards (30) in the card receiving slots (111). The protective string guide (40) is made of a resilient material and is capable of absorbing vibrations.

Note that the throat piece of the present invention obviates the need for spray painting or for fastening (by means of adhesives) the manufacturer's logo or brand name on the throat piece. The manufacturing cost of the throat piece of the present invention is thus lower than that of the prior art. The protective string guide (40) is made of a resilient material to reduce the vibrations borne by the throat piece. The decorative plugs (20) further enhance the marketing appeal of the throat piece.

Figure 5:
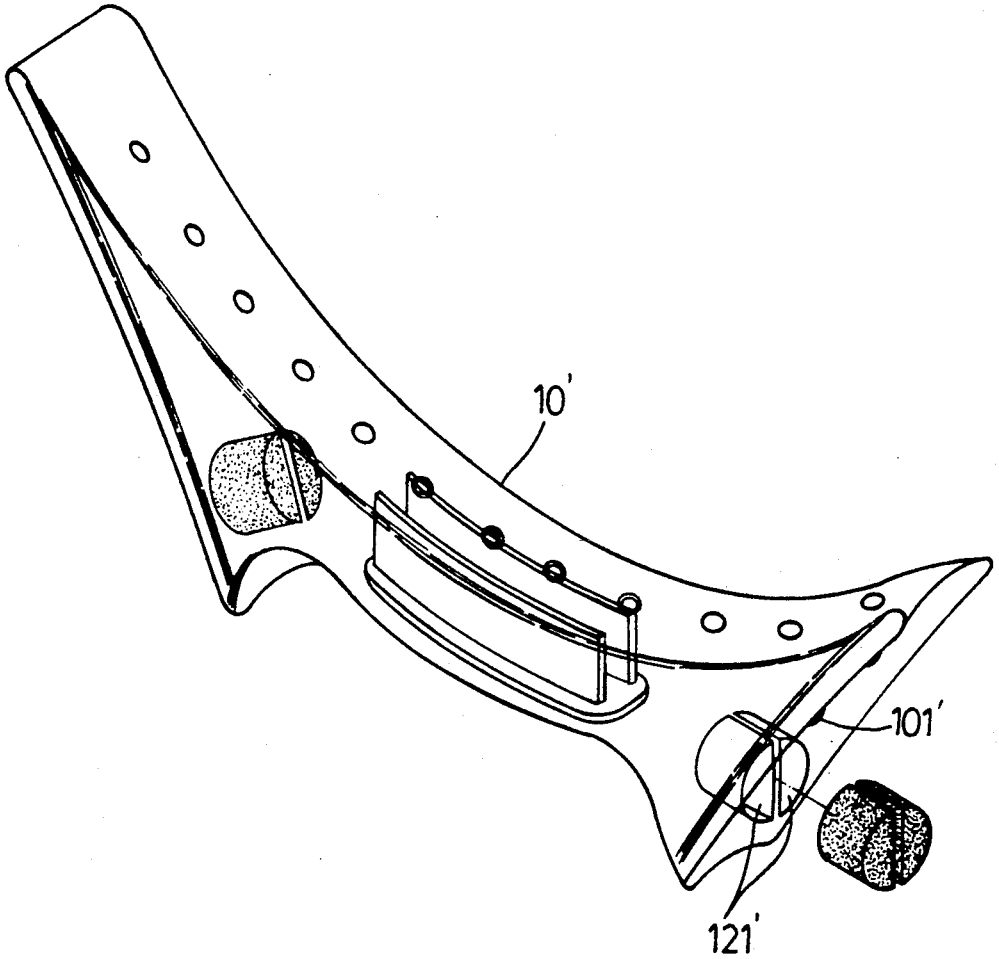
FIG. 5 illustrates the second preferred embodiment of a transparent, decorated throat piece according to the present invention.

Referring to FIG. 5, the throat body (10') of the second preferred embodiment of a transparent, decorated throat piece of the present invention is shown to be provided with a pair of socket means (121') which are formed as a pair of cavities that are semi-circular in cross-section.

Figure 4:
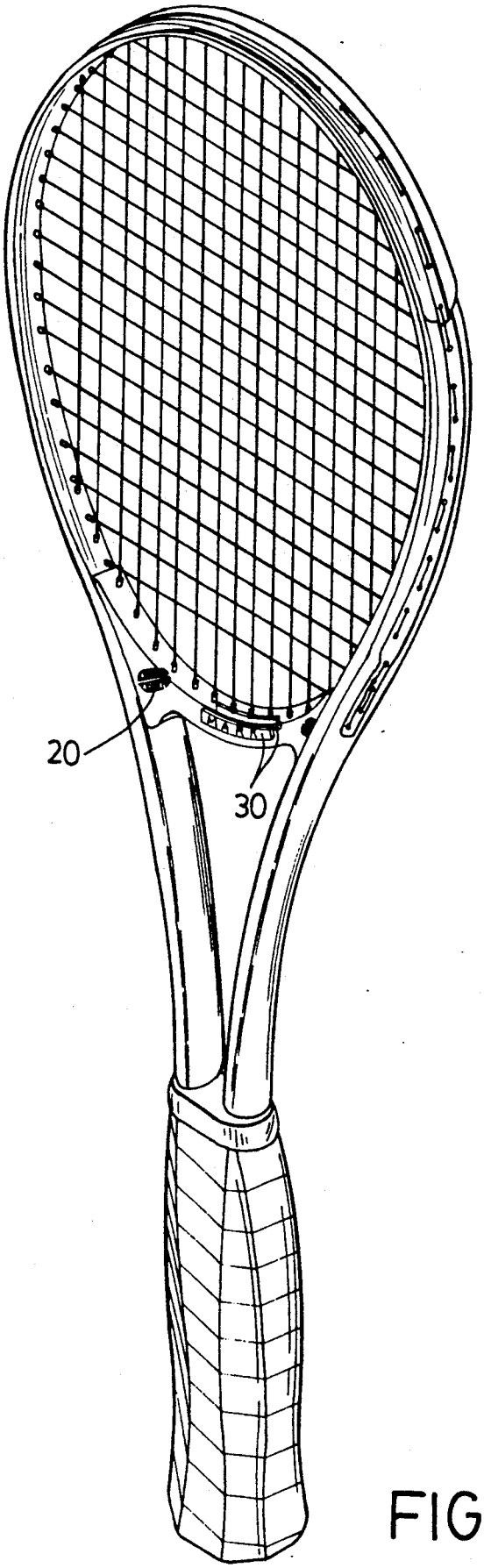
FIG. 4 is an illustration of the first preferred embodiment when installed on a tennis racket frame.
Figure 6:
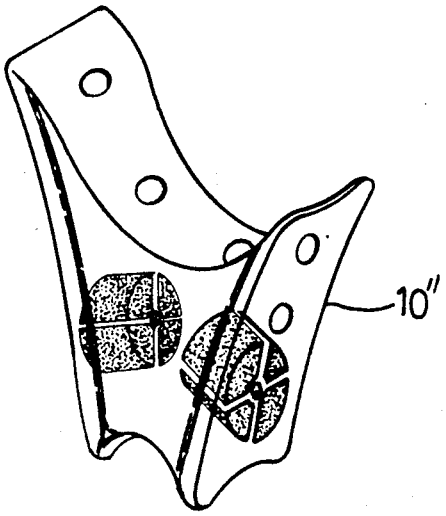
FIG. 6 is an illustration of the third preferred embodiment of a transparent, decorated throat piece of the present invention which is adapted to be installed on a racquetball racket.

The throat piece of the first preferred embodiment is adapted for use on tennis racket frames, as shown in FIG. 4. Referring to FIG. 6, the throat piece (10'') of the third preferred embodiment is modified so as to be adapted for use on a racquetball racket. It has thus been shown that the configuration of the throat body may be modified so as to suit different types of rackets.

Figure 7:
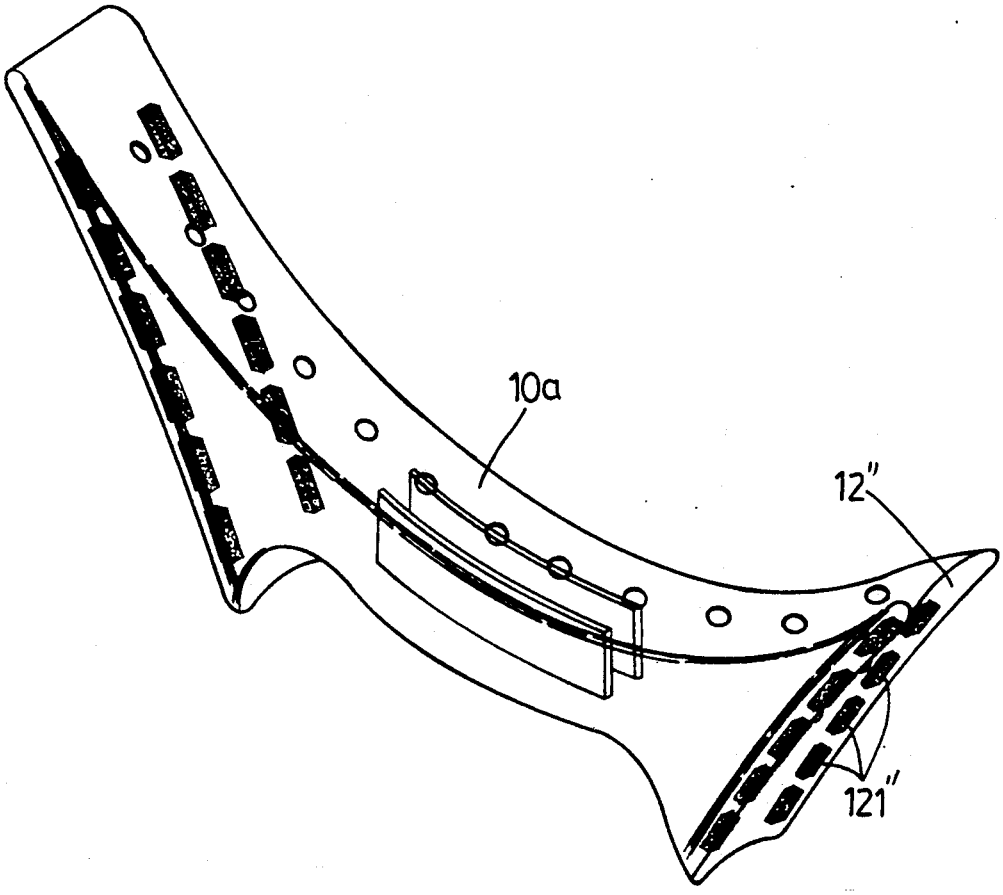
FIG. 7 illustrates the fourth preferred embodiment of a transparent, decorated throat piece of the present invention.

Referring to FIG. 7, the throat body (**10*a*) of the fourth preferred embodiment of a transparent, decorated throat piece according to the present invention is shown to be provided with a pair of socket means (121'') which are formed as a series of rectangular cavities that are arranged adjacent to the longer edges of the racket engaging sides (12''**). It has thus been shown that the shape and the position of the socket means on the racket engaging sides is not critical to the present invention.

While the present invention has been described in connection with what is considered the most practical and preferred embodiments, it is understood that this invention is not limited to the disclosed embodiments but is intended to cover various arrangements included within the spirit and scope of the broadest interpretation so as to encompass all such modifications and equivalent arrangements.

I claim:

1. A racket, comprising:

a throat body made of a transparent plastic material and having a series of spaced string holes formed thereon, said throat body having a curved top face, a bottom face and a pair of racket engaging sides which interconnect said top and bottom faces, said bottom face being formed with a narrow card receiving slot of predetermined depth; and a thin printed card provided in said card receiving slot.

2. The racket as claimed in claim 1, wherein at least one of said engaging sides is provided with a socket means for receiving a decorative plug, said decorative plug being fitted in said socket means for providing a decorative appearance.

3. The racket as claimed in claim 2, wherein each of said engaging sides has a width which gradually expands in a direction of said throat body from said top face to said bottom face, said socket means being formed on a wider section of said engaging sides.

4. The racket as claimed in claim 1, further comprising a protective string guide disposed adjacent to said bottom face and having a plate portion supporting said printed card in said card receiving slot and a series of tubular string receiving portions extending upwardly from said plate portion and into said string holes.

5. The racket as claimed in claim 4, wherein said protective string guide is made of a resilient material for absorbing vibrations.

6. The racket as claimed in claim 2, wherein the racket engaging sides comprise longer edges, and said socket means is formed as a series of rectangular cavities that are arranged adjacent to said longer edges of said racket engaging sides.

* * * * *